US005402147A

United States Patent [19]

Chen et al.

[11] Patent Number: 5,402,147

[45] Date of Patent: Mar. 28, 1995

[54] INTEGRATED SINGLE FRAME BUFFER MEMORY FOR STORING GRAPHICS AND VIDEO DATA

[75] Inventors: Inching Chen, Wappingers Falls; Thomas A. Horvath, Stormville; Andy G. Lean, Merrick; Bob C. Liang, Chappaqua, all of N.Y.

[73] Assignee: International Business Machines Corporation, Armonk, N.Y.

[21] Appl. No.: 969,649

[22] Filed: Oct. 30, 1992

[51] Int. Cl.[6] ..... G09G 1/06

[52] U.S. Cl. ..... 345/115; 345/189; 395/154

[58] Field of Search ..... 395/154, 164; 345/115, 345/116, 112, 119, 213, 185, 186, 189

[56] References Cited

U.S. PATENT DOCUMENTS

| | | | |
|---|---|---|---|
| 4,692,757 | 9/1987 | Tsuhara et al. | 345/116 |
| 4,755,937 | 7/1988 | Glier | 364/200 |
| 4,899,316 | 2/1990 | Nagami | 365/189.01 |
| 4,947,257 | 8/1990 | Fernandez et al. | 358/183 |
| 4,994,912 | 2/1991 | Lumelsky et al. | 358/140 |
| 5,058,041 | 10/1991 | Rose et al. | 364/521 |
| 5,062,057 | 10/1991 | Blacken et al. | 364/518 |
| 5,068,650 | 11/1991 | Fernandez et al. | 340/799 |
| 5,089,982 | 2/1992 | Gran et al. | 364/726 |
| 5,258,750 | 11/1993 | Malcolm, Jr. et al. | 395/154 |

*Primary Examiner*—Ulysses Weldon
*Assistant Examiner*—Doon Chow
*Attorney, Agent, or Firm*—Perman & Green

[57] ABSTRACT

The present invention provides an integrated display system for multi-media workstations wherein graphics image and video data are merged in a single frame buffer. The integrated display system employs 3-port VRAMs with a first serial access port for display data output, and a random access port for graphics data, a second serial access for video data input. The display system includes a single frame buffer memory system for a multi-media workstation which operates compatibly with display systems and logic designed for dual frame buffer systems and it uses the 3-port VRAM in combination with a means incorporating improved input locking, video update or refresh, and encoded video data input stream.

8 Claims, 5 Drawing Sheets

COPROCESSOR
SYSTEM BUS I/F
VGA+XGA CRT + MEMORY CONTROL
ADDR
DATA
SYSTEM BUS
FONT / SPRITE BUFFER
SERIALIZER / PALETTE / DAC (SPD)
SPRITE CONTROL
VGA ATTR. CTL
CTL
ADDR CTL
VIDEO MEMORY
SERIALIZER
PALETTE
DAC
VIDEO TO MONITOR
VFB (AVEC/BVEC)

INTEGRATED SINGLE FRAME BUFFER MEMORY FOR STORING GRAPHICS AND VIDEO DATA

FIELD OF THE INVENTION

The present invention relates to display devices, and more particularly to a multi-media workstation based display device wherein graphics data and video data are merged and stored in a single frame buffer memory.

BACKGROUND OF THE INVENTION

In multi-media work station displays, it is known that two independent rasters, such as a standard TV video and high resolution computer generated graphics video may each be displayed on a high resolution graphics monitor by the use of dual frame buffers. A TV frame buffer includes a dual port VRAM, with the serial and random ports operating asynchronously. The primary port receives incoming TV video synchronously as it comes in, and the secondary port reads the TV video out synchronously with the high resolution graphics monitor. A high resolution frame buffer in a computer is utilized to store high resolution graphics which is read out synchronously with the high resolution graphics monitor. A switching mechanism selects which of the TV video and the high resolution graphics video is to be displayed at a given time. The TV frame buffer includes an on screen and off screen portion. The computer provides computer data, including high resolution graphics data and audio data to the TV frame buffer, with the graphics data being stored in the on screen portion and the audio data being stored in the off screen portion. The audio data is read out to an audio circuit for replay. The graphics data is combined with the TV video for purposes of windowing.

Dual buffers of this type are costly on both space and production. Also, it is difficult to edit the merged graphics and video for separate frames.

An example of a dual frame buffer display system is described in U.S. Pat. No. 4,994,912 issued Feb. 19, 1991 to Lumelsky et al. and entitled AUDIO VIDEO INTERACTIVE DISPLAY.

In addition to dual frame buffers having cost and space and graphics/video data merger drawbacks, it is difficult to extend displays in dual frame buffer systems for higher spatial resolution or higher frame refresh rate and it is difficult to develop drivers for inconsistent buffer sizes, different data formats and the like.

There are several other previously known approaches to combining video with high resolution graphics. Some methods double the scan rate of the incoming video through the use of a line buffer, reading out each video line twice for each line of the high-resolution screen. This method has several drawbacks. First, it assumes that the high-resolution display is exactly twice the scan rate of th incoming video. This is seldom the case, and always requires a gen-lock circuit at the very least to force this strict relationship between the video and the graphics. It also fails to provide random access to the video information from the host workstation, since there is no frame buffer to store the video information. Another method involves converting the video and graphics information into a common format and storing the two into a single, common frame buffer. While this may at first seem to be an advantage in that only one frame buffer is needed, this buffer requires far more memory than having two separate dedicated buffers. In the prior art, in order to use a single frame buffer to store both types of visual data, a very large frame buffer is required that is both "wide" and "deep".

SUMMARY OF THE INVENTION

It is an object of the present invention to provide an integrated display system for multi-media workstations wherein graphics image and video data are merged in a single frame buffer.

Another object of the present invention is to provide an integrated display system for multi-media workstations which employs 3-port VRAMs with a first serial access port for display data output, a second serial access port for video data input, and a random access port for graphics data.

A further object of the present invention is to provide a single frame buffer memory system for a multi-media workstation which operates compatibly with display systems and logic designed for dual frame buffer systems.

A still further object of the present invention is to provide a single frame buffer memory system for a multi-media workstation employing a 3-port VRAM incorporating improved input locking, video update or refresh, and encoded video data input stream.

DESCRIPTION OF THE PREFERRED EMBODIMENT

Figure 1:
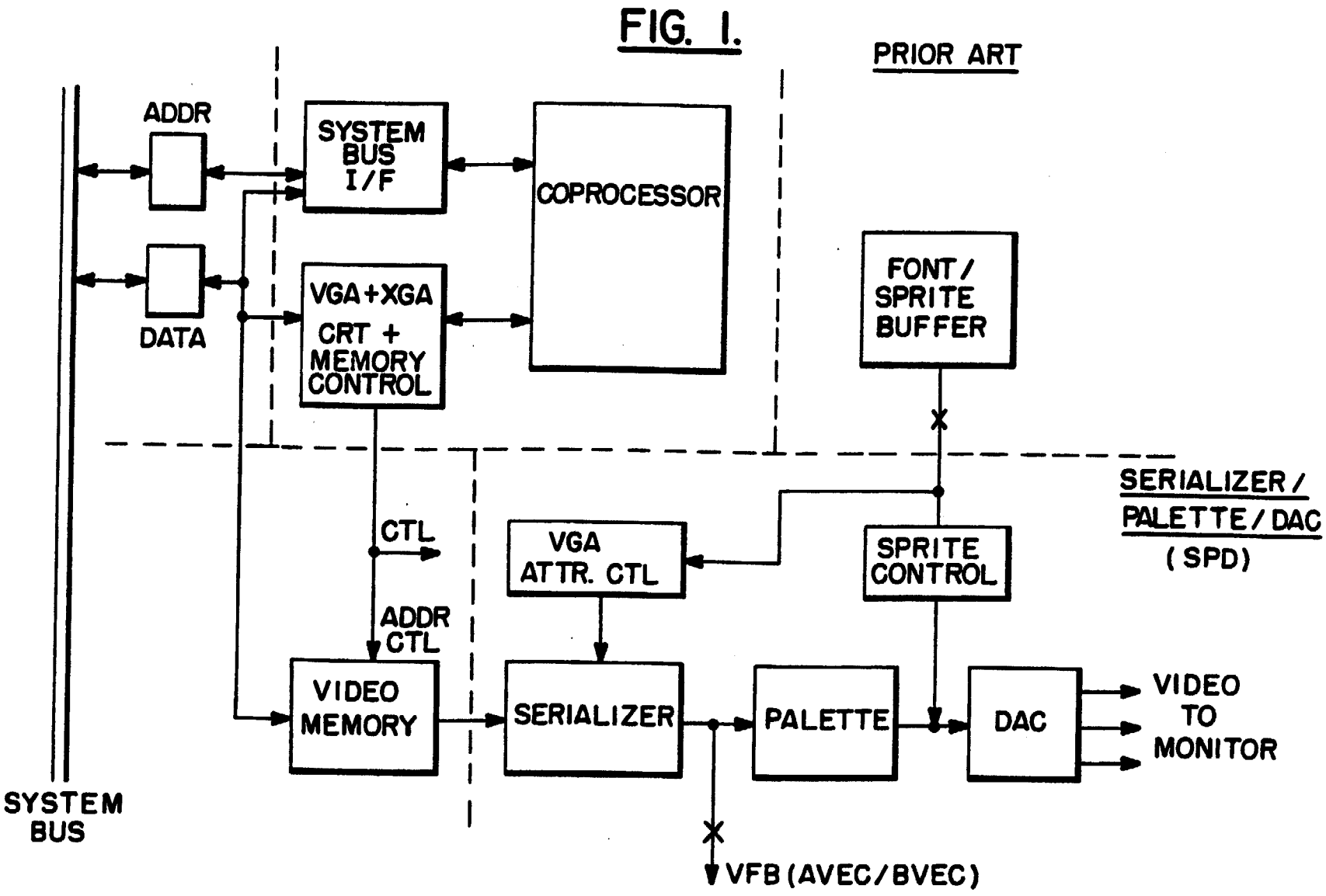
PRIOR ART FIG. 1.
FIG. 1 is a schematic block diagram illustrating logic and display elements for a typical multi-media workstation.

The present invention is incorporated into and provides an improvement to a multi-media workstation of the type shown in FIG. 1. In contrast to personal workstations, a multimedia workstation consists of a processing unit, input devices, storage devices, and a display unit for visual output and other output devices. The multimedia data handled by workstations takes different forms including text, graphics, image, video, and speech via various input modes. When video is introduced into the workstations, the real time nature of the video data, and the mixing of video graphics data, e.g. graphics overlay on video, scrolling text on video, etc. have to be considered. The video of a given frame size has to be displayed at the fixed input rate such as 24 or 30 frames per second. To achieve this, presently known architecture uses two separate frame buffers, one for video and the other for graphics and mixes both video signals at the output side using a technique called chroma-keying.

Figure 2:
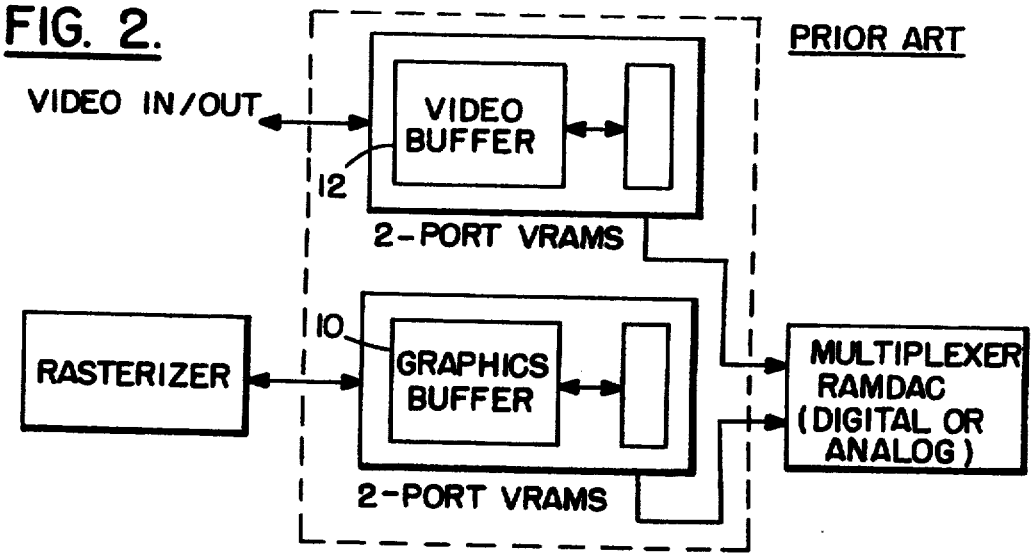
FIG. 2 is a schematic block diagram illustrating a dual frame buffer memory for separately storing graphics and video data according to the prior art.

In FIG. 2, a schematic illustration of an IBM XGA subsystem, typical display architecture for merging video into a graphics workstation is shown using separate frame buffers for video and graphics data. To display live video in a window, a particular color (chroma-key color) is selected as the background color to paint the window in the graphics buffer 10. During display time, for each pixel location (screen location), the pixel data is obtained from the VGA Graphics frame buffer 10 via the Video Feature Bus, and compares the pixel data (in this case, color index) with the chosen chroma-key color (color index). If they match, the pixel data from the Video buffer 12 is displayed; otherwise, the data from Graphics buffer 10 is displayed. For a graphics overlay on the video in the window, the graphics data can be written on the graphics buffer 10 using any color besides the chosen chroma-key background color. The system of FIG. 2 has the drawbacks that it is difficult to extend displays for a higher spatial resolution or a higher frame refresh rate, it is not an efficient hardware platform for programmer to edit the merged graphics and video data and it is cumbersome to develop drivers for inconsistent buffer sizes, different data formats, etc.

Figure 3:
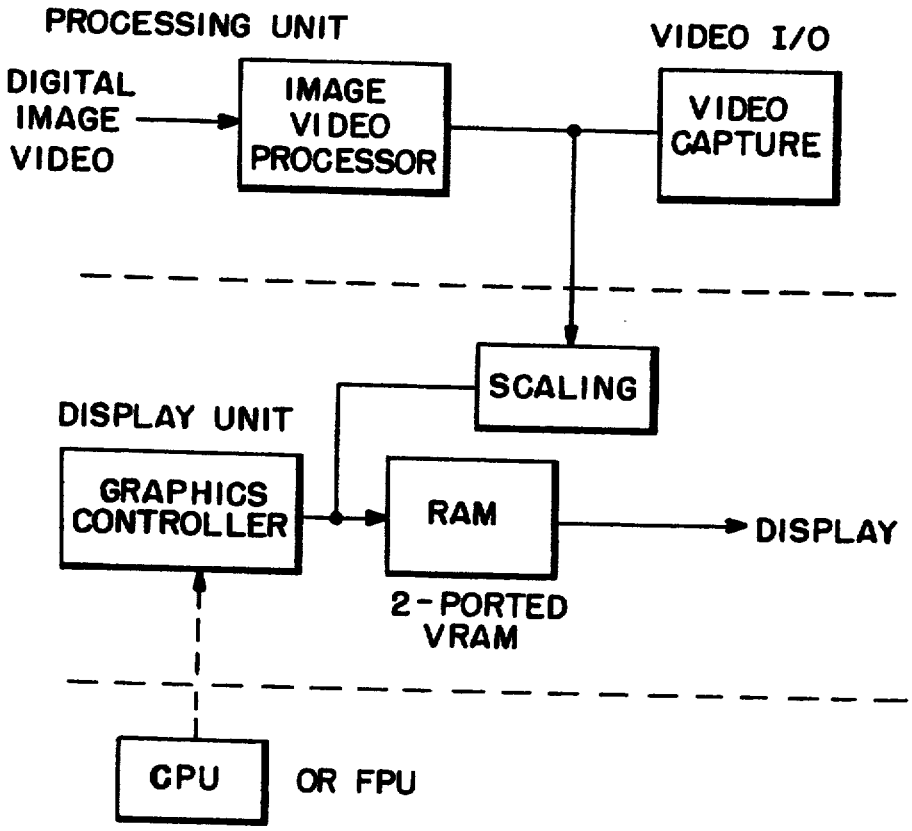
FIG. 3 is a schematic block diagram of a single frame buffer memory using 2-port VRAMs with multiplexing according to the prior art.

In FIG. 3, a typical prior art single frame buffer technique for displaying graphic and video data is shown wherein the random access port of the video random access memory (VRAM) is shared by multiplexing the graphics and video data. In this technique the video input consumes fairly high input bandwidth available from the VRAM frame buffer. In a windowing environment, this implementation could not guarantee the real time display of the video data. Also, the graphics performance will suffer because of the sharing of the same VRAM access port by graphics and video.

The present invention overcomes the drawbacks of the use of dual frame buffers and the use of a single frame buffer in systems of the prior art by providing an integrated single frame buffer system for multi-media work stations that employs a 3-port VRAM means for handling both graphic data and video data and which includes an improved locking mechanism feature, the use of a refresh feature to allow video update to the frame buffer, and an encoded video data input stream.

Figure 4:
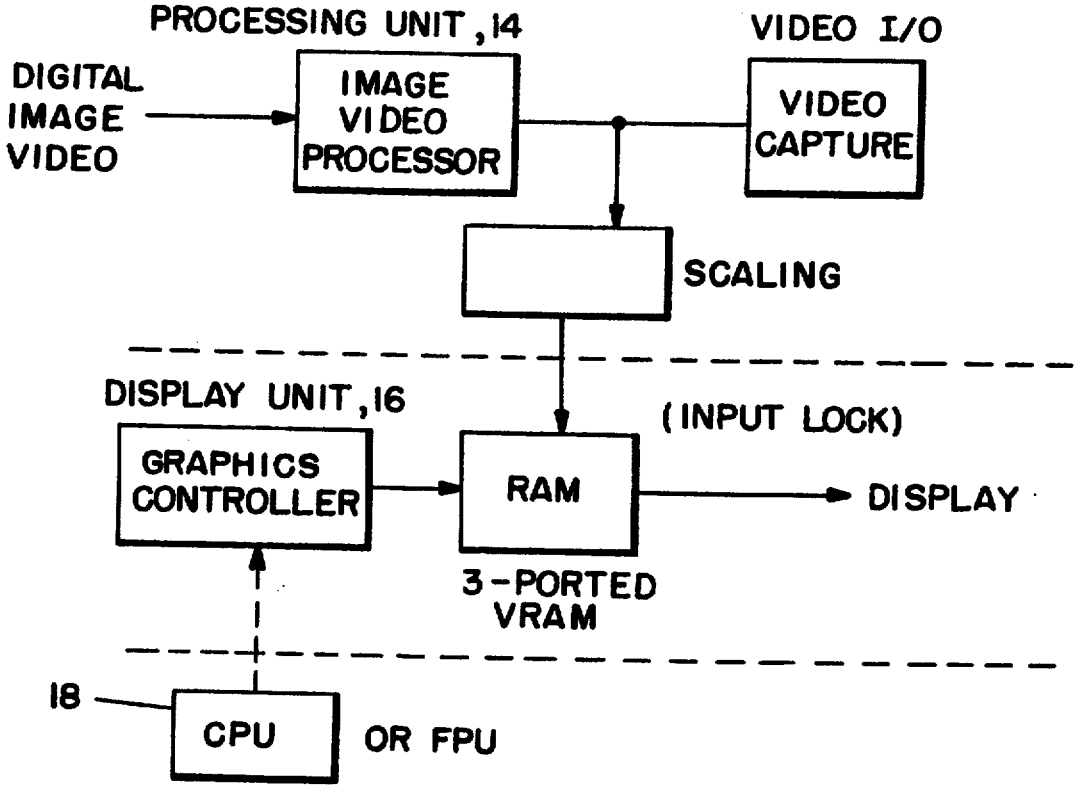
FIG. 4 is a schematic block diagram illustrating an embodiment of single frame buffer memory using 3-port VRAMs according to the principles of the present invention.

Referring to FIG. 4, a multi-media video subsystem is illustrated including a processing unit 14 and a display unit 16 with display unit 16 also having an input from CPU 18. Comparing the processing unit of FIG. 4 with the processing unit of the prior art 2-port VRAM system of FIG. 3 is it seen that they are the same. In fact, the basic distinction of the system of FIG. 4 is the VRAM is a 3-port device 20. In addition to the usual serial access port for display output, the 4-port VRAM 20 of FIG. 3 includes a second serial access port with masked register video input.

Triple port VRAMs are available in the art for use in multi-media work stations. Such devices are manufactured and marketed by Micron Technology, Inc.

Figure 5:
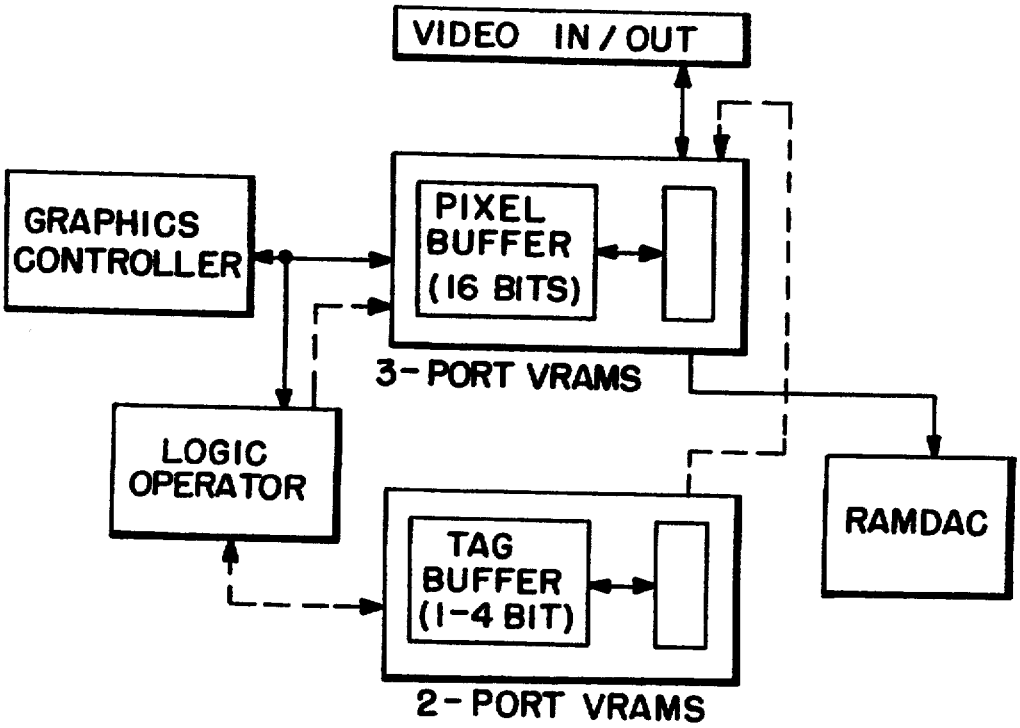
FIG. 5 is a schematic block diagram illustrating a single frame buffer memory using 3-port VRAMs for graphics, video and display data and 2-port VRAMs for control functions.
Figure 6:
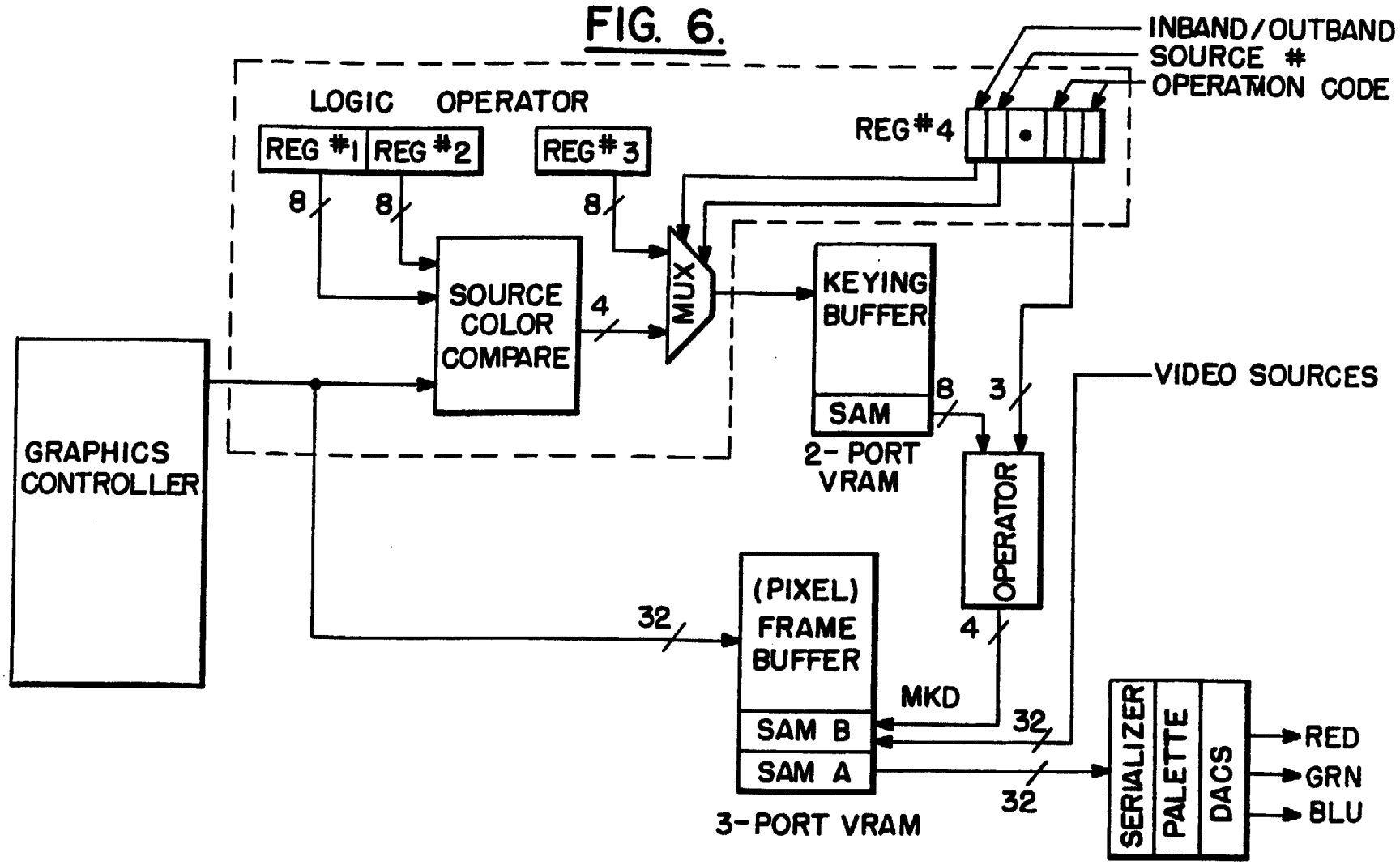
FIG. 6 is a schematic block diagram illustrating a data path for an implementation of an input locking feature incorporated in the present invention.

In the system illustrated in FIG. 5, structure for three improvement techniques are provided. The first technique is referred to as input locking. Referring to FIG. 6, a schematic illustration of a data path for the implementation of input locking is illustrated, and in FIG. 7 the implementation of the input lock bit mechanism of the present invention is operated as in output locking in a dual frame buffer approach for compatibility.

Chroma-keying has been traditionally used as in the art an output lock among multiple frame buffers, where one frame buffer (e.g. graphics) serves as keying or the master, while the other frame buffers (e.g. video(s)) are displayed as keyed or slaves. Output lock as mentioned requires all slave frame buffers be synchronized pixel-by-pixel with the master one, in addition to a destination (or called transparent) color compare circuitry and a digital/analog multiplexer operating at pixel rates.

Input lock, on the other hand, requires only one frame buffer and one keying buffer. All devices, including both master and slaves, must refer to the data on the keying buffer for writing the frame buffer. However, the master can also modify the data on the keying buffer. The updating of the keying buffer can be made transparently, if implemented using a source color compare circuitry, and separate storages for frame buffer and keying buffer. Additional functions, such as area (window) editing, multiple window clipping, graphics/-text overlay and/or scrolling over video, can be incorporated if more keying buffer is used. To extend further, the keying buffer can be in line with Z buffer, alpha buffer, window ID buffer, etc., as extensions of (pixel) frame buffer.

In FIG. 6, although the implementation is shown external to the graphics controller, the logic used can be incorporated within a graphics controller design.

In the implementation, two lock (or keying) bits per pixel are used. Two modes of operations are supported: in-band and out-band. In an in-band mode, the input lock bits are set or reset resulting from a compare between the graphics pixel data and a transparent color (programmed ahead), as seen in chroma-keying. The compare operation is performed on the fly during each memory write operation to (pixel) frame buffer. As described, the keying buffers addressed transparently in an in-band mode. In an out-band mode, the input lock bits are set or reset by the programmed data sent via an I/O data port. This mode of operation does not use any transparent color for comparison, but requires a separate I/O operation.

By analogy with a cache memory implementation, this implementation caches addresses by comparing the graphics controller's pixel data, while the cache memory implementation caches data by comparing the processor's addresses. More specifically, the tag memory is to cache memory as the input lock to frame buffer.

The access mechanism, transparent to users, involves two aspects: the manipulation of lock bits and the data integrity.

The manipulation of lock bits is based on chroma-keying. The chroma-keying has been used in the dual frame buffer approaches, as previously discussed, to multiplex graphics and video data onto the screen. The existing approaches using chroma-keying as destination color compare have been classified and their drawbacks discussed. In the integrated frame buffer of the present invention, the source color compare for chroma-keying is used. The graphics data of an address being accessed is compared against a pre-programmed color code or index (chroma-key). The lock bit of the address is set to "1" if they compare and "0" otherwise.

The implementation of the input locking technique to insure data integrity is an important aspect of the mechanism due to the sharing (or integration) of the frame buffer for both graphics and video data. The inconsistency can develop if the video controller refers to an out-of-date copy of lock bit. For example, the graphics controller updates the lock bit with a non-transparent color, which will reset the associated lock bit to "0". In the mean while, the video controller has maintained a local copy of the lock bit, which was "1". The local copy is maintained within the serial access memory. What would then appear on the screen is video data, taking the place of graphics data just updated.

Figure 7:
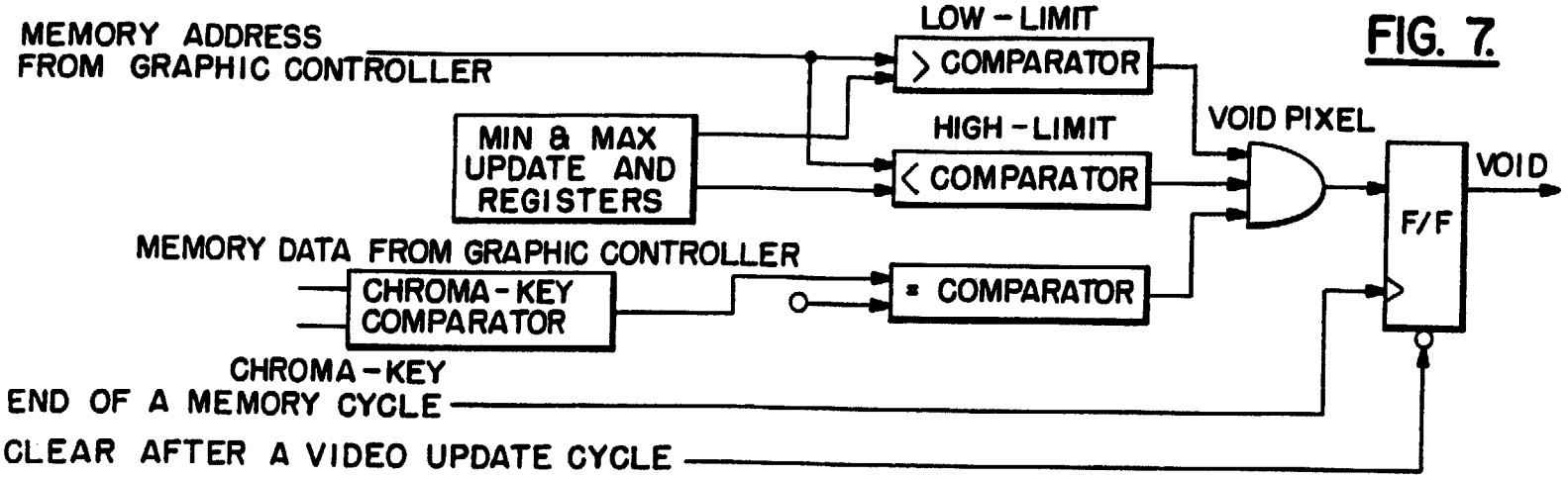
FIG. 7 is a schematic block diagram illustrating an implementation of an input locking feature incorporated in the present invention.

Since the video is transient data, the system provides that graphics data has priority over video data in case of inconsistency. As a part of access mechanism, a detection circuitry of inconsistency has been incorporated. Once occurred, the updating of video would be void. As depicted in FIG. 7, the system detects for each memory access of graphics data whether or not (1) its address falls in the same range to which the local copy of lock bits refers, and (2) its data do not compare (or its associated lock bit is being updated to "0").

If both condition 1 and 2 are satisfied, the updating of video will be then void. It should be noted that the information of current address range of lock bits (whose data has been kept locally by the video controller) is constantly updated and store in min-max registers, shown in FIG. 7 for comparators of high and low limits.

The use of the feature of the additional lock bit per pixel, functions such as multi-window clipping, and graphics/text scrolling over video can be employed. In multi-window clipping, two video windows (A & B) can be incorporated, each window having its own keying buffer, e.g. bit 0 for window A and bit 1 for window B. The priority can be pre-determined and specified in the operation code, eg A>B, if opcode="001". So, when the window A is accessing the keying buffer with opcode="001", the video pixel can address the pixel data buffer, if bit 1, 0="1" "1" or "0" "1". On the other hand, the window B can only address the pixel frame buffer when bit 1, 0="0" "1".

In graphics/text scrolling over video (doubled buffering) the graphics/text scroll can be facilitated when both lock bits are used alternatively for a window. Assuming that at the moment, bit 0(1) is used, containing locations of graphics/text data and bit 1(0) has been cleared. When it comes the time to scroll the graphics/text, bit 1(0) will be used at the next moment, while the bit 0(1) is being cleared.

Other functions, such as logical AND (shrink), OR (expand), 0 (all disabled) and 1 (all disabled), can all be similarly implemented.

Another feature of the present invention is the use of refresh logic to allow video update to the frame buffer.

In using a three port video RAM (VRAM) the normal mode of operation of the video input is to serially shift the video data into the serial port of the VRAM which results in writing data to the static memory portion. Once the static memory has been filled or a predefined boundary has been reached it is necessary to move the contents of the static memory into the dynamic memory. In order to accomplish this it is necessary to retain exclusive use of the dynamic memory for the period of time that it takes to move the data from the static to the dynamic memory and consequently from the dynamic to the static memory. This implies that there needs to be a mechanism in place which provides access to the dynamic memory without interference. The device which controls the access to the VRAM ports is the graphic processor engine. It controls the parallel port accesses for graphics updates and it controls the serial port to the display unit for the display operation. If the graphics controller is designed to handle the video port it also controls the third serial port for video updates as needed. However, most graphics processors are not designed for supporting a video data stream and therefore require another mechanism to allow video updates. In the case that the graphics processor is designed to handle arbitration by other devices for access to the VRAM the problem can be solved by the arbitration mechanism. In this case the arbitrating device, which handles video, can gain access to the VRAMs parallel port as well as the serial video port to allow it video updates. The problem that exists with the XGA graphics controller as well as many other graphics controllers is that they were designed in such a way that they assume exclusive ownership of the VRAM and do not provide either a video interface control nor an arbitration mechanism.

In the present invention, a technique is provided to allow video updates without interfering with normal graphics operations. A mechanism which can provide this capability is through the manipulation of the refresh interface between the graphics processor and the VRAM. In the case of the IBM XGA graphics controller a refresh operation occurs once very 9.8 microseconds. It is necessary to refresh 256 rows of the VRAM every 4 milliseconds, which means that a refresh has to occur every 15.6 microseconds. Due to the use in the page mode access of memory the IBM XGA controller provides more refreshes than necessary to maintain valid data in the VRAM. That is, it provides up to 408 refreshes every 4 milliseconds where only 256 are required, leaving up to 152 extra refreshes that are not necessary. As a result it is possible to steal some of the extra refresh cycles from the graphics processor and use them for updating the incoming video. This can be accomplished as long as there are fewer refresh cycles stolen than are necessary to maintain the VRAM. For the case of video updates it is necessary to steal one refresh cycle for every line update. In the worst case scenario there are up to 768 lines of video that can be displayed. Assuming that the video rate is no more than 30 frames per second, this works out to be approximately 103 stolen refresh cycles every 4 milliseconds. This still leaves an excess of 49 refresh cycles every 4 milliseconds which ensures that the VRAM has a sufficient number of refresh cycles.

The stealing of the refresh cycles is accomplished by channelling the VRAM control signals, generated by the graphics processor, through some high speed logic on the card. The purpose of this high speed logic is to detect a refresh operation generated by the graphics processor and if there is a pending update request by the video controller, to block the refresh operation and generate a video update operation in its place. If there is no pending request from the video controller, then all refresh operations are simply passed through this logic without interference. In addition, all normal read and write operations generated by the graphics processor are always passed through regardless of pending video request. The detection of refresh operations in the case of the XGA graphics controller is accomplished by simply detecting a Column Address Strobe (CAS) occurring before a Row Address Strobe (RAS). This is one standard way of refreshing the dynamic memory within the VRAM chip. This mode of refresh has the advantage that the refresh counter on the VRAM is used and an external refresh need not be generated. If a refresh operation is blocked by the external logic, then the counter is simply not incremented until a legitimate refresh operation occurs. This is advantageous since it does not require any additional hardware to keep the refresh address count so that no addresses are inadvertently skipped. In the case that a refresh operation is blocked due to a pending update request, a block write operation is executed in its place. The RAS or CAS addresses for the write operation are generated by the external logic and placed on the address bus. The control logic to the VRAM is regenerated with some delay. It is important that the delay through the external circuitry is minimized in order not to exceed the timing requirements to the VRAM. In some cases, as with the IBM XGA or the TI 34-020 graphics controllers, the refresh timing parameters can be programmed. If this is the case, then it is a simple matter to program the refresh operations to be long enough to absorb any delays incurred through the external logic.

Once the serial Static RAM in the VRAM becomes filled with video data, a request is made by the video control logic to move the data from SRAM to the DRAM portion on the memory. Because the move of the data can not be performed until a refresh operation from the graphics processor is executed, there is some elapsed time during which additional incoming video data has to be handled by the video controller. Since the video data cannot be held off and the SRAM is full, some additional storage has to be provided to temporarily hold the incoming video data until the SRAM becomes available. The size of the temporary data buffer is a function of the incoming video data rate as well as the maximum amount of time that the hardware has to wait for a refresh operation to occur. For example, if the incoming video data rate is approximately 20 Mbytes/second and the maximum amount of time between refreshes is 9.8 microseconds, the buffer has to hold up to 196 bytes of data. Additional buffering is needed to ensure the continuous incoming video stream has a place to be held while the existing 196 bytes are moved from the buffer to the SRAM in the VRAM. By using a standard 1K byte first in first out (FIFO) a worst case operational environment is insured.

Still another feature of the present invention is the technique wherein the video data input stream is encoded.

Upon receiving incoming video data, an 18-bit wide synchronous FIFO device is used as an input buffer. Two extra bits are used for encoding the video input stream. The Horizontal Sync pulse triggers a flip-flop which generates a state bit that indicates the status of a video scanline while the Vertical Sync pulse generates another state bit to indicate the status of video frame. By reading the status change from these two extra encoded bits, a flag for sequence change or frame change can be raised. These flags signal the need of writing a line of data to the DRAM pixel Buffer from the dedicated serial port or the need of getting new window address; therefore, generate the memory access request to XGA memory controller accordingly. These two possible memory access requests would grab a memory refresh cycle as soon as it becomes available. We have observed that more than enough DRAM refresh cycles have been issued by the memory controller. The requests from the new line or the new frame, steal excessive memory refresh cycles to load the window address or to write the data that is already in the serial port to the DRAM side of the VRAM buffer.

The two concurrent memory accesses include serial port to DRAM write for the previous scan line and lock-bit memory read for the current scanline. The lock-bit of the current scanline is stored in a dual-ported memory while the video data of the previous scanline is stored in a three-ported memory. For every token that has been granted for memory access, there are two events taking place at the same time. The first event is to write the previous scanline that already resides in the dedicated serial port into DRAM; and the second event is to read the current scanline's control lock-bit from DRAM port of the 2-ported keying buffer (lock-bit) to its serial port. This is a look ahead scheme for video and graphics windows overlay operation, which is prepared for the next serial port to DRAM Pixel Buffer operation.

Figure 8:
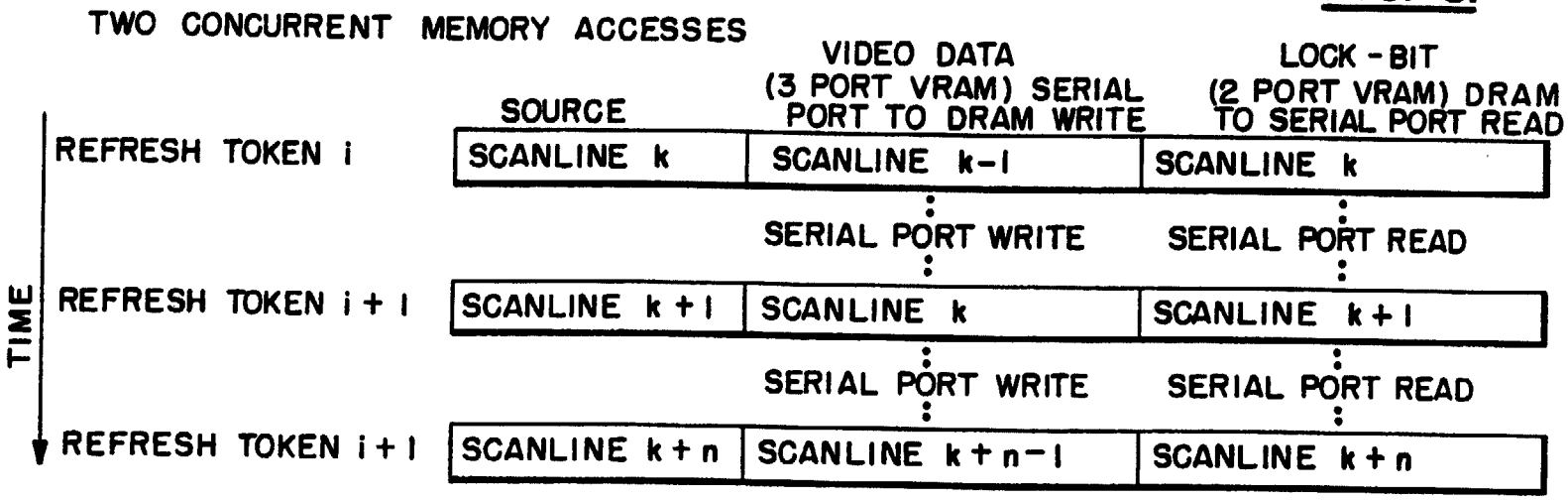
FIG. 8 is a diagram used in explaining a typical memory access pattern of the present invention.

This is being executed in a parallel fashion for each granted cycle steal. Between two tokens granted for memory cycle steal, one of two serial ports on the 3-ported VRAM keeps receiving the video data output from the FIFO; while the lock-bit data on the 2-ported VRAM has been read from its serial port as illustrated in FIG. 8.

While the invention has been particularly shown and described with respect to a preferred embodiment thereof, it will be understood by those skilled in the art that changes in form and details may be made therein without departing from the scope and spirit of the invention.

Having thus described our invention, what we claim as new, and desire to secure by Letters Patent is:

1. In a multi-media display system for providing an integrated display of video, graphics and image data on a display monitor and including a source of digital image signals, a source of graphics signals, a processing unit responsive to said digital image video signals, said processing unit including an image video processing means responsive to said digital image video signals, a video capture means connected to said image video processor means and a scaling means connected to said image video processor means and to said video capture means for scaling image data of said digital image video signals, a display unit responsive to said digital image data signals and to graphic data signals, said display unit having means containing a stored pre-programmed color index and a graphics rasterizer means, and a three-port video random access memory structure connected to said color index and graphics rasterizer means and to said scaling means for functioning as a graphic and video buffer means, the improvement characterized in a graphics control means connected to said processing unit and said display unit for providing control signals for writing said digital image video signals into said three-port video random access memory structure and for providing control signals for writing said graphics signals into said three-port random access memory structures;

and an input locking means connected to the output of said control means, including-logic operator means for comparing said graphics signals to said stored pre-programmed color index for providing one of two lock bits in response to said comparing function wherein said lock bit is enabled for a compare occurrence and is disabled for a non-compare occurrence, wherein said logic operator means of said input locking means included first, second third and fourth storage registers, said, first and second storage registers containing said pre-programmed color index data, a source color comparison means connected to the output of said graphics controller means and to the outputs of said first and second registers, and a multiplexer means connected to the outputs of said third storage register means and said source color comparison means, said source color comparison means being responsive to graphics data from said graphics controller means associated with an address being accessed and also responsive to said pre-programmed color index stored in said first and second storage-registers for providing a 1 bit for a compare and a 0 bit for a non-compare, said fourth storage register being connected to said multiplexer means for providing inband and outband mode signals to said multiplexer for setting and resetting said lock bits.

2. A multi-media display system of the type according to claim 1 wherein said multiplexer means is further responsive to the output of said fourth register for providing a control signal;

and wherein said multi-media display system further includes a two-port video random access memory means connected to the output of said multiplexer means of said input locking means, said two-port video random access memory means functioning as a keying buffer means.

3. A multi-media display system of the type according to claim 2 wherein said fourth storage register of said logic operator means provides a first, in-band operating mode signal and a second, out-band operating mode signal to said multiplexer wherein said in-band signal provides an indirect update mechanism signal dependent on a comparison operation between graphics data and programmed transparent color data, and wherein said out-band signal provides a direct update mechanism dependent on programmed data provided from an input/output data port.

4. A multi-media display system of the type according to claim 3 wherein said lock bits are enabled and disabled in response to either said compare operation of said in-band mode or are enabled and disabled in response to said programmed data from said input/output port.

5. A multi-media display system of the type according to claim 2 further including means for connecting said two-port keying buffer random access memory and said fourth storage register to a first serial access input port of said three-port video random access memory means for providing display pixel masking indicators to said three-port video random access memory means functioning as a pixel frame buffer;

wherein said source of video data is connected to a second serial access input port of said three-port video random access memory means;

and wherein said output of said graphics controller means is connected to a random access input port for providing graphics data to said three-port video random access memory.

6. In a multi-media display system of the type according to claim 1 wherein said graphics controller means provides a plurality of refresh operations to said three-port video random access memory and wherein said graphics controller can be configured to provide a greater number of refreshes than there are rows requiring refresh in said three-port video access memory;

the improvement characterized in first detection means connected to said graphics controller for detecting a refresh operation signal generated by said graphics controller in the form of a column address strobe signal occurring before a row address strobe signal, second means connected to said video processor means for detecting a video update request signal from said video processor means;

and means connected to said first and second detection means and responsive to said refresh operation signal and said video update request signal for blocking said refresh operation signal and providing a video update signal in place thereof.

7. In a multi-media display system of the type according to claim 6 wherein said image video processor includes a video input memory means responsive to said video signals and containing control bits associated with synchronizing information from said video source, a flip-flop means responsive to the systems horizontal and vertical sync pulses, said flip-flop providing a first control bit in response to said horizontal sync pulse for indicating the status of a video scanline and for providing a second control bit in response to said vertical sync pulse for indicating the status of a video frame.

8. In a multi-media display system of the type according to claim 7 responsive to said first and second bits from said flip-flop means for providing a signal indicating a sequence change and a frame change respectively, said sequence change signal providing a first memory request signal to said three-port video random access memory for writing a line, and said frame change signal providing a second memory request signal to the system memory controller of said processing unit wherein said pair of first and second memory request signals provide an indicator signal to cause an update cycle instead of a refresh cycle to said three-port video random access memory.

* * * * *